US006825811B2

(12) United States Patent
Iwai et al.

(10) Patent No.: US 6,825,811 B2
(45) Date of Patent: Nov. 30, 2004

(54) DISPLAY-ANTENNA INTEGRAL STRUCTURE AND COMMUNICATION APPARATUS

(75) Inventors: Hiroshi Iwai, Katano (JP); Atsushi Yamamoto, Osaka (JP); Koichi Ogawa, Hirakata (JP); Hiroaki Kosugi, Hirakata (JP); Kenichi Yamada, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 102 days.

(21) Appl. No.: 10/213,515

(22) Filed: Aug. 6, 2002

(65) Prior Publication Data

US 2003/0038751 A1 Feb. 27, 2003

(30) Foreign Application Priority Data

Aug. 9, 2001 (JP) ..... 2001-242929

(51) Int. Cl.[7] ..... H01Q 1/24; H01Q 1/48
(52) U.S. Cl. ..... 343/702; 343/846
(58) Field of Search ..... 343/702, 846, 343/841, 872, 700 MS, 741, 745, 749, 767

(56) References Cited

U.S. PATENT DOCUMENTS

| | | | | |
|---|---|---|---|---|
| 5,007,105 A | | 4/1991 | Kudoh et al. | |
| 6,326,919 B1 | | 12/2001 | Diximus et al. | |
| 6,614,405 B1 | * | 9/2003 | Mikkonen et al. | 343/872 |
| 2001/0034242 A1 | * | 10/2001 | Takagi | 455/550 |
| 2002/0021250 A1 | * | 2/2002 | Asano et al. | 343/702 |
| 2002/0061775 A1 | | 5/2002 | Iwai et al. | |
| 2002/0190905 A1 | * | 12/2002 | Flint et al. | 343/702 |

FOREIGN PATENT DOCUMENTS

| | | |
|---|---|---|
| EP | 0 701 296 | 3/1996 |
| EP | 1 209 760 | 5/2002 |
| JP | 07-288415 | 10/1995 |
| JP | 11-274966 | 10/1999 |
| JP | 2000-196343 | 7/2000 |
| WO | WO 99/57785 | 11/1999 |

* cited by examiner

*Primary Examiner*—Don Wong
*Assistant Examiner*—Chuc Tran
(74) *Attorney, Agent, or Firm*—RatnerPrestia

(57) ABSTRACT

A display-antenna integral structure has an antenna and a display wherein said antenna has an antenna element and a grounding plate, said antenna element and said display are opposed to each other, and a part of said display has conductivity and is commonly used as said grounding plate.

23 Claims, 17 Drawing Sheets

Fig. 12 (a) PRIOR ART
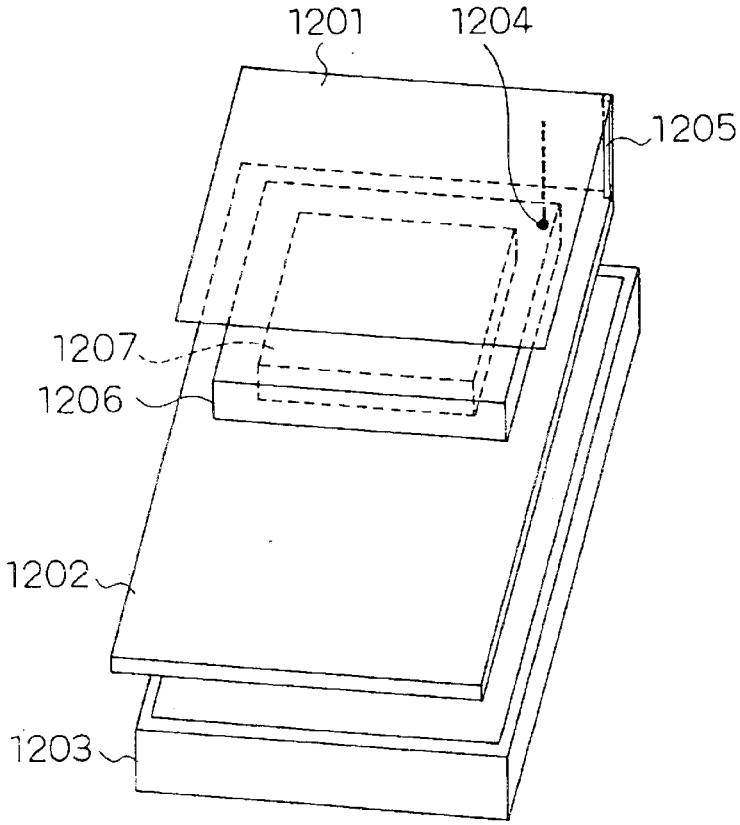
Fig. 12 (b) PRIOR ART
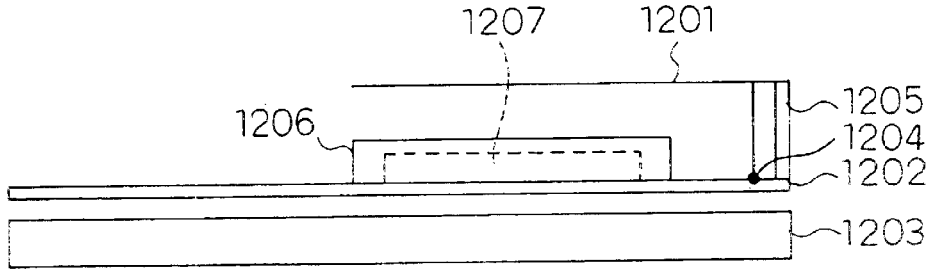

DISPLAY-ANTENNA INTEGRAL STRUCTURE AND COMMUNICATION APPARATUS

BACKGROUND OF THE INVENTION

1. Field of the Invention

The present invention relates to a display-antenna integral structure, in which a built-in antenna and a display used for a mobile phone and so on are integrated.

2. Related Art of the Invention

Mobiles phone terminals have rapidly decreased in size and thickness. Further, antennas have been integrated in the housings of mobile phone terminals in accordance with the worldwide trend.

FIG. 12(*a*) is a perspective view schematically showing a configuration of a built-in antenna of a mobile phone terminal according to a conventional technique. FIG. 12(*b*) is a side view showing the same. In FIGS. 12(*a*) and 12(*b*), an antenna element 1201 is means of transmitting and receiving radio waves from a mobile phone terminal, a substrate 1202 is means having a shield case 1206 and a communication radio circuit 1207 integrated in the shield case 1206, and an LCD display 1203 is means of displaying information of the mobile phone terminal.

Moreover, the antenna element 1201 is fed from a feeding point 1204 on the substrate 1202 and has an end electrically connected to a part of the substrate 1202 via a conductive connecting part 1205. Here, the part of the substrate 1202 and the shield case 1206 are electrically connected to each other and serve as a grounding plate of the antenna element 1201. Therefore, the antenna element 1201, the part of the substrate 1202, and the shield case 1206 constitute the built-in antenna.

The built-in antenna of the conventional mobile phone terminal has the above-described configuration. In order to respond to smaller and thinner terminals, as shown in FIG. 12(*b*), the conventional built-in antenna substantially has three layers of the antenna element 1201, the substrate 1202, which includes the radio circuit 1207 and is provided for forming the grounding plate, and the LED display 1203. Since the substrate 1202 is included, the thickness is considerably large and has been obstruction of realizing a thinner terminal.

As a technique for solving the above-described problem, a configuration example shown in FIGS. 13(*a*) and 13(*b*) has been proposed: in a housing 1301 of a mobile phone terminal, a space for a built-in antenna is provided on the upper part of an LCD display 1203, a part of a substrate 1202 is placed as a grounding plate 1208 in the space on the side of an LCD display screen 1203*a*, and an antenna element 1201 is placed so as to be opposed to the grounding plate 1208. Here, FIG. 13(*a*) schematically shows a side sectional view of the mobile phone terminal, and FIG. 13(*b*) schematically shows the front of the terminal.

However, mobile phone terminals have been transformed into data terminals from conventional telephones, and displays thereof have remarkably increased in size.

In response, when the space for the antenna is obtained on the upper part of the LCD display as shown in the configuration example of FIGS. 13(*a*) and 13(*b*), the larger the display, the mobile phone terminal increases in height. The increased height has made it difficult to achieve folding-type mobile phone terminals that are suitable for larger displays.

SUMMARY OF THE INVENTION

The present invention has been achieved in view of the above-described problem and provides a display-antenna integral structure, a communication apparatus, and a portable communication terminal, whereby even when a display is larger, a space for a built-in antenna can be sufficiently obtained and a housing can be reduced in thickness.

One aspect of the present invention is a display-antenna integral structure comprising an antenna and a display wherein said antenna has an antenna element and a grounding plate, said antenna element and said display are opposed to each other, and a part of said display has conductivity and is commonly used as said grounding plate.

Another aspect of the present invention is the display-antenna integral structure, wherein said display comprises a display main body, a frame provided around said display main body, and a reflecting plate provided on a back of an image display screen of said display main body, and all or part of said reflecting plate has conductivity and is commonly used as said grounding plate.

Still another aspect of the present invention is the display-antenna integral structure, wherein said reflecting plate and said antenna element are integrally-molded.

Yet still another aspect of the present invention is the display-antenna integral structure, wherein said display comprises a display main body, and a frame provided around said display main body, and all or part of said frame has conductivity and is commonly used as said grounding plate.

Still yet another aspect of the present invention is the display-antenna integral structure, wherein said frame and said antenna element are integrally-molded.

A further aspect of the present invention is the display-antenna integral structure, wherein said display further comprises a reflecting plate provided on a back of an image display screen of said display main body, and all or part of said reflecting plate has conductivity and is commonly used as said grounding plate.

A still further aspect of the present invention is the display-antenna integral structure, wherein said frame and reflecting plate are integrally-molded and are commonly used as said grounding plate.

A yet further aspect of the present invention is a communication apparatus comprising said display-antenna integral structure and a housing for storing said display-antenna integral structure, wherein at least all or part of said housing opposed to said antenna element has conductivity and is commonly used as said grounding plate.

A still yet further aspect of the present invention is the display-antenna integral structure, wherein no driving circuit for driving said display is provided between said antenna element and said display.

An additional aspect of the present invention is the display-antenna integral structure, further comprising a dielectric provided entirely or partially in a space between said antenna element and said grounding plate.

A still additional aspect of the present invention is the display-antenna integral structure, wherein said antenna resonates at a plurality of frequencies.

A yet additional aspect of the present invention is the display-antenna integral structure, wherein a part of said frame on the side of said image display screen extends on a surface space adjacent to said display, said antenna element partially extends in a direction of said surface space, said extended frame and said antenna element are opposed to each other in said surface space, and a feeding point of said antenna element is provided on said opposing part.

A still yet additional aspect of the present invention is the communication apparatus, wherein said antenna element partially extends in a direction of a surface space adjacent to said display, said extended antenna element is partially opposed to the conductive part of said housing, and a feeding point of said antenna element is provided on said opposing part.

A supplementary aspect of the present invention is the display-antenna integral structure, wherein said antenna element and said display are partially opposed to each other, and a driving circuit for driving said display is provided on a back of a remainder of said display, said remainder not being opposed to said antenna element.

A still supplementary aspect of the present invention is the communication apparatus, wherein a part not being opposed to said antenna element on said housing has no conductivity.

A yet supplementary aspect of the present invention is the display-antenna integral structure, wherein said antenna further comprises a passive element on a side having said antenna element placed thereon, said element being opposed to said display.

A still yet supplementary aspect of the present invention is the display-antenna integral structure, further comprising a plurality of said antenna elements.

Another aspect of the present invention is the display-antenna integral structure, wherein any one of said plurality of antenna elements is used for transmission and the others are used for reception.

Still another aspect of the present invention is the display-antenna integral structure, wherein said plurality of antenna elements resonate at different frequency bands.

Yet still another aspect of the present invention is the display-antenna integral structure, wherein at least two of said plurality of antenna elements are resonated simultaneously.

Still yet another aspect of the present invention is a portable communication terminal comprising: said communication apparatus;

transmitting means of transmitting a radio wave signal from said antenna; and receiving means of receiving a radio wave signal inputted from said antenna.

A further aspect of the present invention is the portable communication terminal, comprising said antenna and antenna connection switching means of switching connection with said transmitting means or said receiving means, wherein said transmitting means comprises:

modulating means of modulating an aural or video signal;

transmission-side filter means of allowing passage through a specific band of said modulated signal; and transmission-side amplifying means of amplifying a signal passing through said transmission-side filter means, and said receiving means comprises: receiving-side amplifying means of a signal inputted from said antenna;

reception-side filter means of allowing passage through a specific band of a signal inputted from said antenna and/or said amplified signal; and demodulating means of demodulating a signal passing through said reception-side filter means to obtain an aural or video signal.

A still further aspect of the present invention is the mobile phone terminal, wherein said transmitting means performs at least transmission of voice data, and said receiving means performs at least reception of voice data, and said terminal is used as a mobile phone.

BRIEF DESCRIPTION OF THE DRAWINGS

FIG. 1(*b*) is a side view showing the antenna-liquid crystal integral module according to Embodiment 1 of the present invention;

FIG. 3(*b*) is a diagram showing the configuration of the metallic frame 104' in the antenna-liquid crystal integral module according to Embodiment 2 of the present invention;

FIG. 3(*c*) is a diagram showing the configuration of the metallic frame 104' in the antenna-liquid crystal integral module according to Embodiment 2 of the present invention;

FIG. 7(*b*) is a side view showing the configuration of the communication apparatus according to the related technique of the present invention;

FIG. 12(*a*) is a perspective view schematically showing a configuration of a built-in antenna of a mobile phone terminal according to a conventional technique;

FIG. 12(*b*) is a side view schematically showing the configuration of the built-in antenna of the mobile phone terminal according to the conventional technique;

FIG. 13(*b*) is a front view schematically showing the mobile phone terminal according to the conventional technique;

FIG. 14(*b*) is a side view showing another configuration example of the antenna-liquid crystal integral module according to Embodiment 1 of the present invention;

FIG. 15(*b*) is a front view showing another configuration example of the communication apparatus having the antenna-liquid crystal integral module according to Embodiment 3 of the present invention;

FIG. 16(*b*) is a side view schematically showing the configuration of the antenna-liquid crystal integral module according to Embodiment 6 of the present invention;

FIG. 17(*b*) is a side view showing another configuration example of the antenna-liquid crystal integral module according to Embodiment 1 of the present invention.

DESCRIPTION OF THE SYMBOLS

Figure 1:
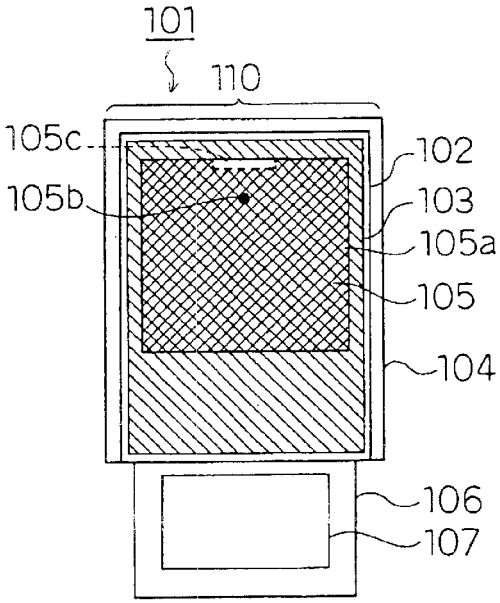
FIG. 1(*a*) is a rear view schematically showing a configuration of an antenna-liquid crystal integral module according to Embodiment 1 of the present invention.
Figure 1:
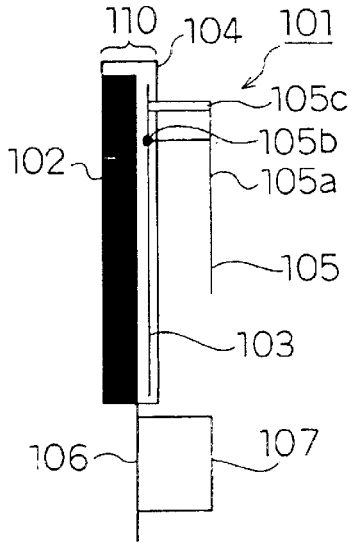

101 antenna-liquid crystal integral module
102 display main body
103 metallic reflecting plate
103' nonconductive reflecting plate
104 frame
104' metallic frame
105 built-in antenna
105*a* antenna element
105*b* feeding point
105*c* connecting part
106 substrate
107 driver circuit
110 liquid crystal display
113, 114 housing
113, 114' metallic part

EMBODIMENTS OF THE INVENTION

Referring to drawings, the following will discuss embodiments of the present invention.

Embodiment 1

FIG. 1(*a*) is a rear view showing a configuration of an antenna-liquid crystal integral module according to Embodiment 1 of the present invention. FIG. 1(*b*) is a side view showing the same.

As shown in FIGS. 1(*a*) and 1(*b*), an antenna-liquid crystal integral module 101 comprises a liquid crystal display 110, a built-in antenna 105 provided on the back of the liquid crystal display 110, a substrate 106 provided under the liquid crystal display 110, and a driver circuit 107 provided on the back of the substrate 106.

Further, the liquid crystal display 110 is constituted by a display main body 102, a metallic reflecting plate 103 provided on the back of the image display screen of the display main body 102, and a frame 104 which is a non-conductive member shaped like quasi-U for storing the display main body 102 and the reflecting plate 103. The liquid crystal display is driven by the driver circuit 107 and displays an image on the image display screen of the display main body 102.

Moreover, an antenna element 105*a* formed into a rectangular plate has an end electrically connected to the reflecting plate 103 via a metallic connecting part 105*c*, and the antenna element 105*a* is operated by feeding from a feeding point 105*b*, which is provided on the reflecting plate 103 and in a plane opposed to the display main body 102 and the reflecting plate 103. At this moment, the output to the feeding point 105*b* is supplied from communication means (not shown) on the substrate 106.

In the antenna-liquid crystal integral module 101 configured thus, the antenna element 105*a* is directly provided on the back of the liquid crystal display 110, and the reflecting plate 103 and the antenna element 105*a* are connected to each other via the connecting part 105*c*, so that the reflecting plate 103 functions as a grounding plate of the antenna element 105*a*. Namely, in the antenna-liquid crystal integral module of the present embodiment, the built-in antenna 105 is constituted by the antenna element 105*a* and the reflecting plate 103.

In the case where such an antenna-liquid crystal integral module is used for a portable communication terminal, when a space for placing a liquid crystal display is available, an antenna can be simultaneously mounted inside the housing of the portable communication terminal.

Further, since the substrate 106 is not provided between the antenna element 105*a* and the liquid crystal display 110 but under the liquid crystal display, the driving circuit 107 for driving the display main body 102 can be provided under the liquid crystal display 110.

Therefore, it is possible to achieve a thin portable communication terminal while the driver circuit is provided, the substrate serving as a ground is reduced in thickness, and the necessity for additional space for a built-in antenna is eliminated. Such an antenna-liquid crystal integral module of the present embodiment is suitable particularly for folding-type mobile phone terminals.

Moreover, since the antenna element 105*a* is positioned on the back of the liquid crystal display 110, SAR can be reduced.

Additionally, since the reflecting plate 103 is metallic, the liquid crystal display can be increased in strength.

Besides, although in the above-described embodiment, the reflecting plate 103 is entirely made of a metal, the reflecting plate 103 may be partially made of a metal.

Particularly, when a part not being opposed to the antenna element 105*a* is made of a nonmetal, the impedance characteristic of the antenna can be adjusted and a wide-band characteristic is expected.

Also, the reflecting plate 103, the antenna element 105*a*, and the connecting part 105*c* may be integrally molded. In this case, it is expected that the number of components is reduced, the antenna-liquid crystal integral module becomes thinner, and the grounding plate is increased in grounding force.

Figure 14:
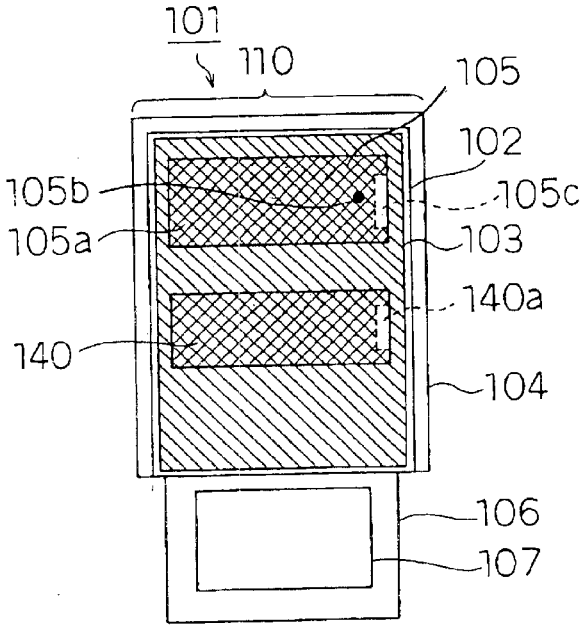
FIG. 14(*a*) is a rear view showing another configuration example of the antenna-liquid crystal integral module according to Embodiment 1 of the present invention.
Figure 14:
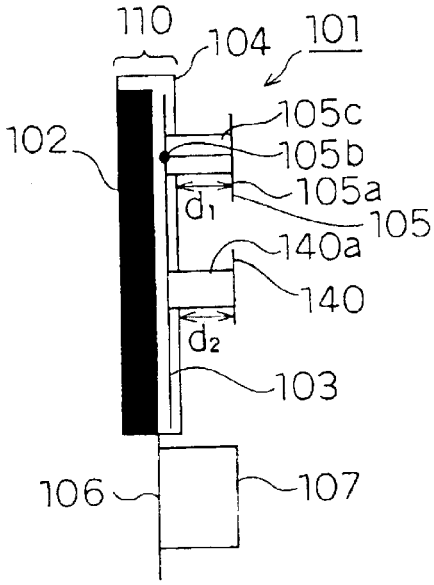

Additionally, as shown in FIGS. 14(*a*) and 14(*b*), the antenna element 105*a* may be reduced in area, and a passive element 140 having the same shape may be provided under the antenna element 105*a*. Here, FIG. 14(*a*) is a rear view, and FIG. 14(*b*) is a side view.

Like the antenna element 105*a*, the passive element 140 may have an end electrically connected to the reflecting plate 103 via a metallic connecting part 141. In this case, it is desirable that the passive element 140 be adjusted in size so as to operate as a $\lambda/4$ resonator in a desired frequency band. Besides, when the passive element 140 is not electrically connected to the reflecting plate 103, it is desirable that the passive element 140 be adjusted in size so as to operate as a $\lambda/2$ resonator in a desired frequency band.

With such a configuration, the antenna element of a wider band can be expected. Moreover, it is possible to control directional gain so as to strongly transmit radio waves in a desired direction.

Moreover, in FIG. 14(*b*), a distance d1 between the liquid crystal display 110 and the antenna element 105*a* is equal to a distance d2 between the liquid crystal display 110 and the passive element 140. The distance d1 and the distance d2 may be different from each other.

Embodiment 2

Figure 2:
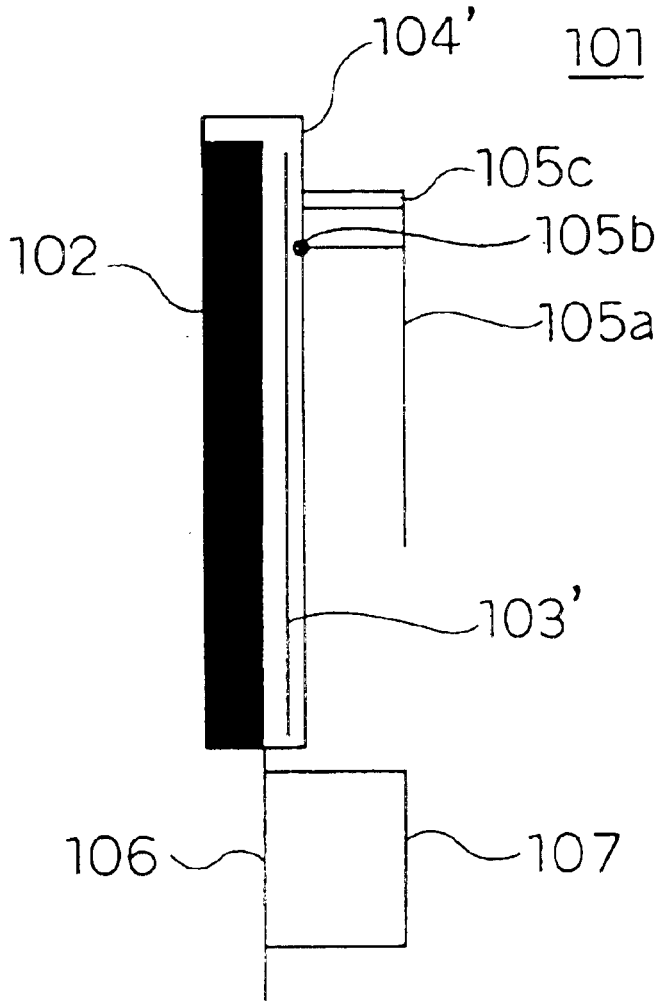
FIG. 2 is a side view showing a configuration of an antenna-liquid crystal integral module according to Embodiment 2 of the present invention.

FIG. 2 is a side view showing a configuration of an antenna-liquid crystal integral module according to Embodiment 2 of the present invention.

In FIG. 2, the same members or the corresponding members of FIGS. 1(*a*) and (*b*) are indicated by the same reference numerals and specific explanation thereof is omitted.

The present embodiment is different from Embodiment 1 in that a nonconductive reflecting plate 103' is provided instead of the metallic reflecting plate 103 and a metallic frame 104' is provided instead of the frame 104.

Additionally, in a built-in antenna 105, an antenna element 105*a* formed into a rectangular plate has an end electrically connected to the metallic frame 104' via a metallic connecting part 105*c*, the antenna element 105*a* is operated by feeding from a feeding point 105*b* which is provided on the metallic frame 104' and in a plane opposed to the display main body 102 and the reflecting plate 103. At this moment, the output to the feeding point 105*b* is supplied from communication means (not shown) on the substrate 106.

In an antenna-liquid crystal integral module 101 configured thus, the antenna element 105*a* is directly provided on the back of the liquid crystal display 110, and the metallic frame 104' and the antenna element 105*a* are connected to each other via the connecting part 105*c*, so that the metallic frame 104' functions as a grounding plate of the antenna element 105*a*. Namely, in the antenna-liquid crystal integral module of the present embodiment, the built-in antenna is constituted by the antenna element 105*a* and the metallic frame 104'.

In the case where such an antenna-liquid crystal integral module is used for a portable communication terminal, when a space for placing a liquid crystal display is available, an antenna can be simultaneously mounted inside the housing of the portable communication terminal. Therefore, it is possible to obtain the same effect as Embodiment 1, in which a thickness of a portable communication terminal is reduced, without the necessity for providing another space for the built-in antenna. Such an antenna-liquid crystal integral module of the present embodiment is suitable particularly for folding-type mobile phone terminals.

Further, since the metallic frame 104' is used so as to increase the strength of the frame, the frame can be reduced in thickness, thereby entirely reducing the thickness of the liquid crystal display 110.

Figure 3:
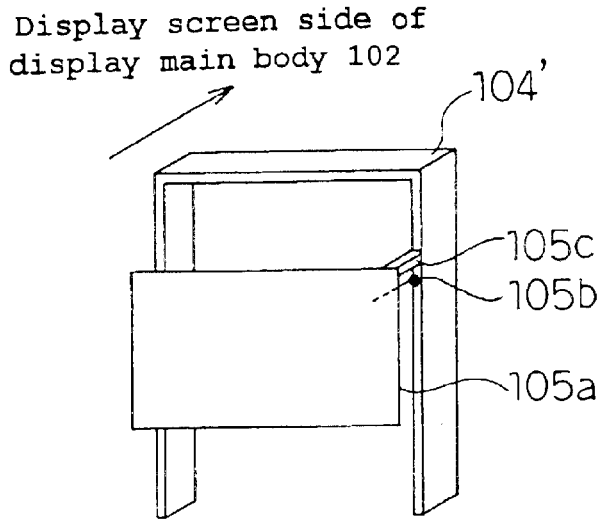
FIG. 3(*a*) is a diagram showing a configuration of a metallic frame 104' in the antenna-liquid crystal integral module according to Embodiment 2 of the present invention.
Figure 3:
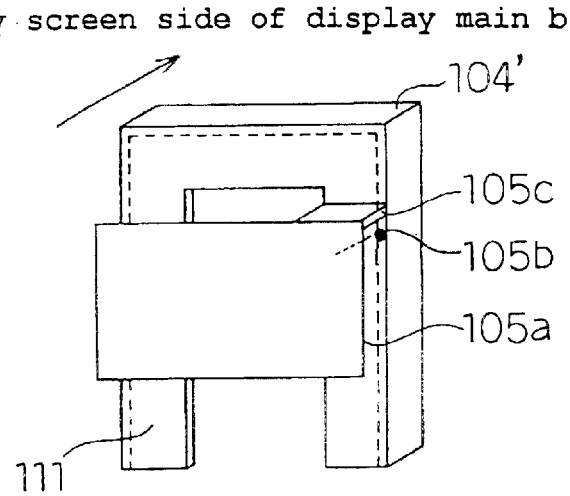
Figure 3:
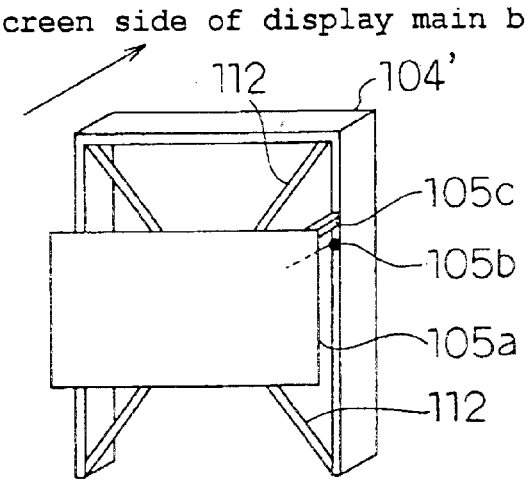

As shown in FIG. 3(*a*), the metallic frame 104' may be formed as a frame surrounding the display main body 102. As shown in FIG. 3(*b*), a wider edge may be provided on the back of the display main body 102. In this case, the wide edge 111 and the antenna element 105*a* are opposed to each other.

Further, as shown in FIG. 3(*c*), bars 112 may be provided on the back of the display main body 102. In this case, the bars 112 and the antenna element 105*a* are opposed to each other. Moreover, the outside shape of the antenna element 105*a* may be equal in size to the outline of the metallic frame 104'. In this case, the outline of the metallic frame 104' and the antenna element 105*a* are opposed to each other.

In brief, the metallic frame 104' is acceptable as long as the frame 104' is partially opposed to the antenna element 105. Moreover, the opposing part is not limited by the specific configuration including the bars and the edge.

Further, regarding the configuration examples of FIGS. 3(*b*) and 3(*c*), on the metallic frame 104', only the wide edge 111 or the bars 112 are made of a metal and the other parts may be made of a nonmetallic or nonconductive material.

Also, the metallic frame 104', the antenna element 105*a*, and the connecting part 105*c* may be integrally molded. In this case, it is expected that the number of components is reduced, the antenna-liquid crystal integral module becomes thinner, and the grounding plate is increased in grounding force.

Further, the above-described embodiment discussed that the nonconductive reflecting plate 103' is provided. The metallic reflecting plate 103 of Embodiment 1 may be used instead of the reflecting plate 103' and may be electrically connected to the metallic frame 104'. In this case, the grounding force increases so as to further improve the characteristics of the antenna. Moreover, the metallic reflecting plate 103 and the metallic frame 104' may be integrated. In this case, it is expected that the number of components is reduced, the antenna-liquid crystal integral module becomes thinner, and the grounding plate is increased in grounding force.

Besides, the above-described embodiment discussed that the display comprises the display main body 102, the metallic frame 104', and the nonconductive reflecting plate 103'. However, some displays do not have reflecting plates. In this case, when the metallic frame 104' is entirely or partially made of a metal and functions as a grounding plate of the antenna element 105*a*, it is possible to expect the same effect as that of the above-described embodiment.

Embodiment 3

Figure 4:
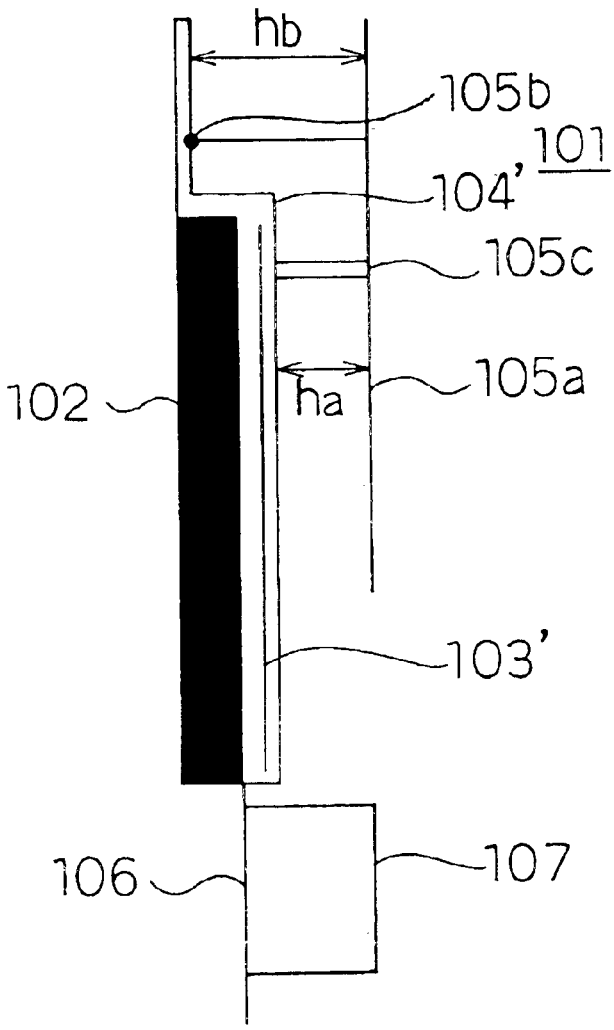
FIG. 4 is a side view showing a configuration of an antenna-liquid crystal integral module according to Embodiment 3 of the present invention.

FIG. 4 is a side view showing a configuration of an antenna-liquid crystal integral module according to Embodiment 3 of the present invention.

In FIG. 4, the same members or the corresponding members of FIG. 2 are indicated by the same reference numerals and specific explanation thereof is omitted.

The present embodiment is different from Embodiment 2 in that a part of a metallic frame 104' on the display screen of a display main body 102 is extended upward in a surface direction of the display main body 102, an antenna element 105*a* is extended in the same direction, and a feeding point 105*b* of the antenna element 105*a* is provided on the extended part of the metallic frame 104'.

As to the antenna element 105*a* of Embodiment 2, the height from a grounding position including the feeding point 105*b* is equal to a distance ha from an edge of the metallic frame 104'. Meanwhile, in the present embodiment, the height of a grounding position including the feeding point 105*b* is equal to a distance hb from the display screen of a display main body 102. The distance hb is longer than the distance ha.

Thereby, it is expected that the height of the built-in antenna can be substantially increased and wide-band characteristics are realized. Moreover, since it is possible to reduce a distance between the antenna element and the display, it is expected that the antenna-liquid crystal integral module is reduced in thickness. Such an antenna-liquid crystal integral module of the present embodiment is suitable particularly for folding-type mobile phone terminals.

Additionally, the above explanation discussed the configuration in which the metallic frame 104' is extended upward in the surface direction of the display main body 102. The configuration is not limited to the above, and the metallic frame 104 may be extended in a direction other than the surface direction of the display main body. Particularly when the metallic frame 104' is extended downward in the surface direction of the display 102, the grounding plate can be larger and it is expected that the antenna has a wider band. Further, it is possible to reduce a density of current applied to the metallic frame 104'. Hence, SAR is expected to decrease.

Embodiment 4

Figure 5:
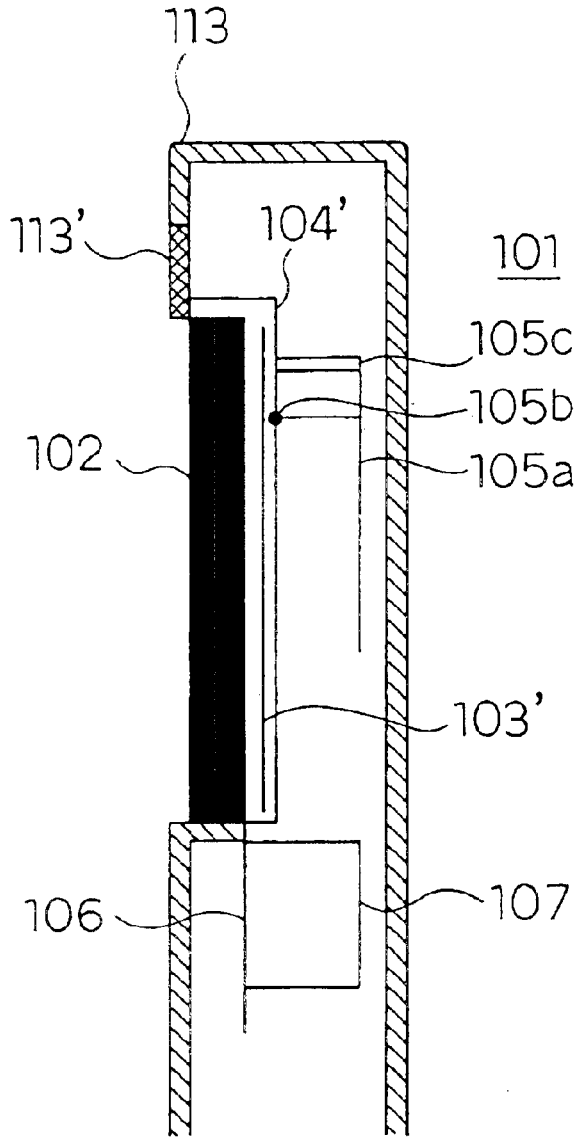
FIG. 5 is a side sectional view showing a configuration of a communication apparatus having the antenna-liquid crystal integral module according to Embodiment 3 of the present invention.

FIG. 5 is a side sectional view showing a configuration of a communication apparatus having the antenna-liquid crystal integral module according to Embodiment 3 of the present invention.

In FIG. 5, the same members or the corresponding members of FIG. 2 are indicated by the same reference numerals, and specific explanation thereof is omitted.

The present embodiment relates to the communication apparatus having the antenna-liquid crystal integral module of Embodiment 2. On a housing 113 which stores the antenna-liquid crystal integral module and is rectangular in cross section, the upper part of a display main body 102 is partially made of a metal, and a metallic part 113' and a metallic frame 104' are electrically connected to each other.

In this case, the grounding force is increased as compared with an antenna-liquid crystal integral module used as a single module, thereby further improving the stability of the built-in antenna. Such an antenna-liquid crystal integral module of the present embodiment is suitable particularly for folding-type mobile phone terminals.

Also, like Embodiment 2, the metallic reflecting plate 103 of Embodiment 1 may be used instead of a nonconductive reflecting plate 103' and may be electrically connected to the metallic frame 104'. In this case, the reflecting plate 103, the metallic frame 104', and a metallic part 113' are brought into conduction, so that the grounding force is increased and the stability of the antenna can be further improved.

Besides, the above-described explanation discussed as an example the communication apparatus having the antenna-liquid crystal integral module of Embodiment 2. As a communication apparatus having the antenna-liquid crystal integral module of Embodiment 1, the reflecting plate 103 and the metallic part 113' may be electrically connected via a conductive member.

Figure 6:
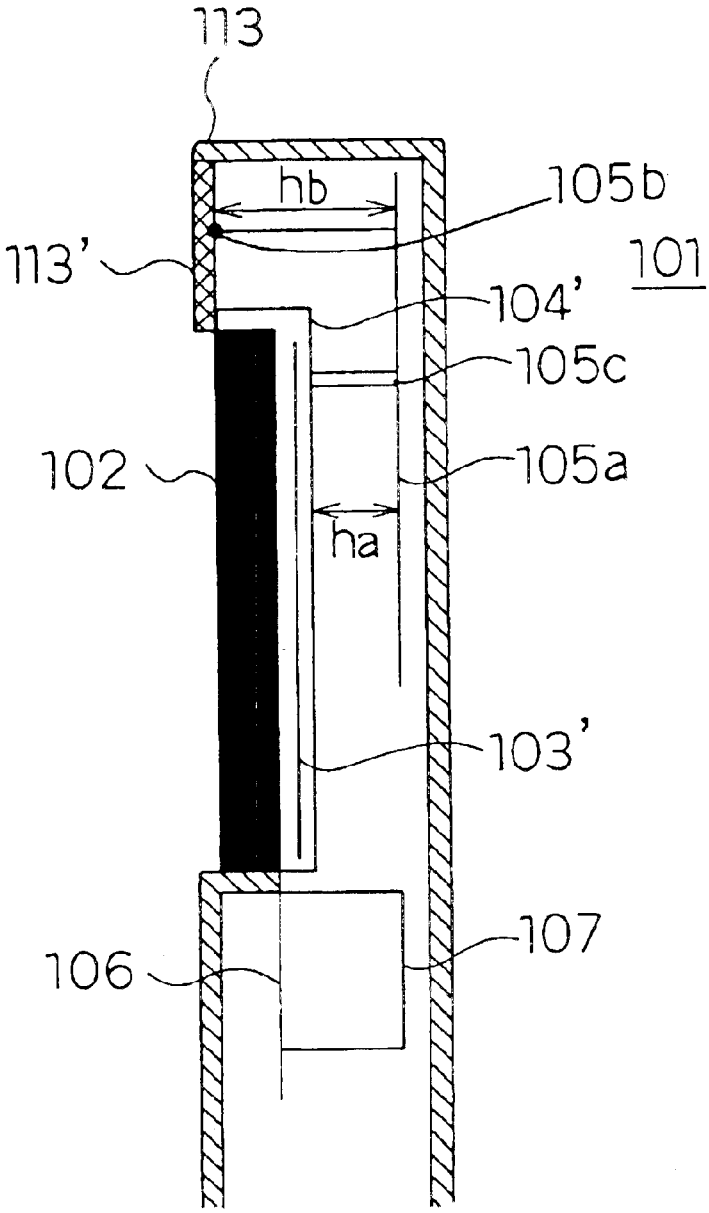
FIG. 6 is a side sectional view showing another configuration example of the communication apparatus having the antenna-liquid crystal integral module according to Embodiment 3 of the present invention.

Besides, as shown in FIG. 6, an antenna element 105*a* is extended upward in a surface direction of the display main body 102, and a feeding point 105*b* may be provided on the metallic part 113'. In this case, like Embodiment 3, it is possible to obtain a height from a grounding part so as to substantially increase a height of the built-in antenna. Thus, it is expected that wide-band characteristics are realized. Additionally, since a distance between the antenna element and the display can be reduced, it is expected that the antenna-liquid crystal integral module can be decreased in thickness.

Figure 15B:
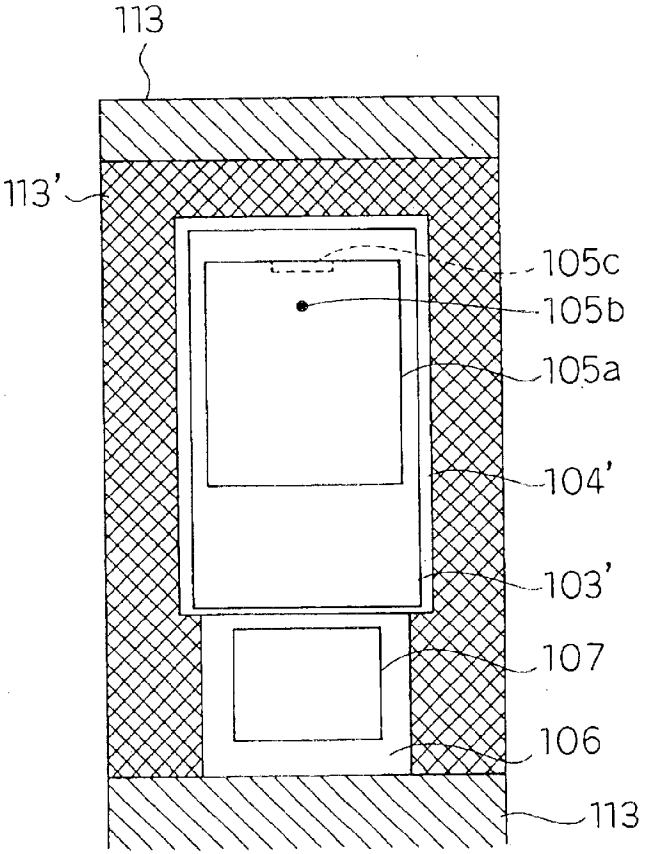
FIG. 15(*a*) is a side sectional view showing another configuration example of the antenna-liquid crystal integral module according to Embodiment 3 of the present invention.
Figure 15A:
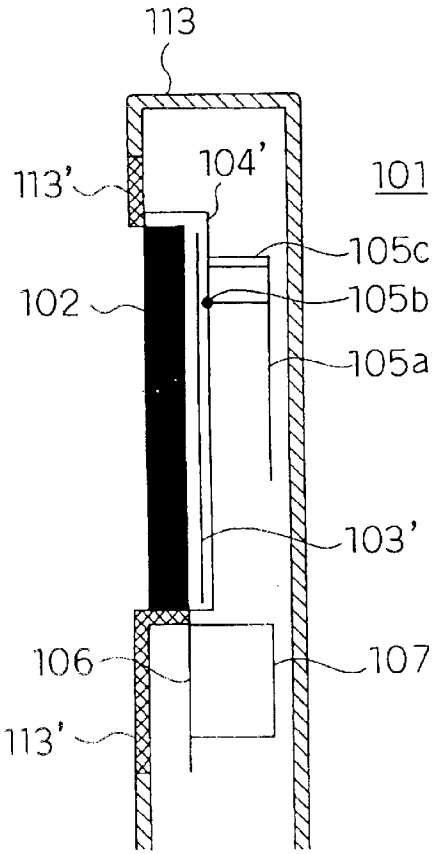

Moreover, the above explanation discussed the metallic part 113' is a part of the upper part of the display main body 102. As shown in FIGS. 15(*a*) and 15(*b*), the lower part of the display main body 102 may be also made of a metal. Here, FIG. 15(*a*) is a partial rear view, and FIG. 15(*b*) is a side sectional view. In the example of FIG. 15, the lower part of the display main body 102 partially serves as the metallic part 113'. The metallic part 113' including other lower parts (not shown) may be entirely made of a metal.

Therefore, both of upper and lower sides or one of the sides may be made of a metal. Besides, a part not being opposed to the antenna element 105*a* may be made of a metal. Thus, it is possible to increase the capability of the grounding plate, so that it is expected that a wide-band antenna is achieved. Furthermore, since a density of current applied to the metallic part can be reduced, SAR is expected to decrease.

Related Technique 1

Figure 7:
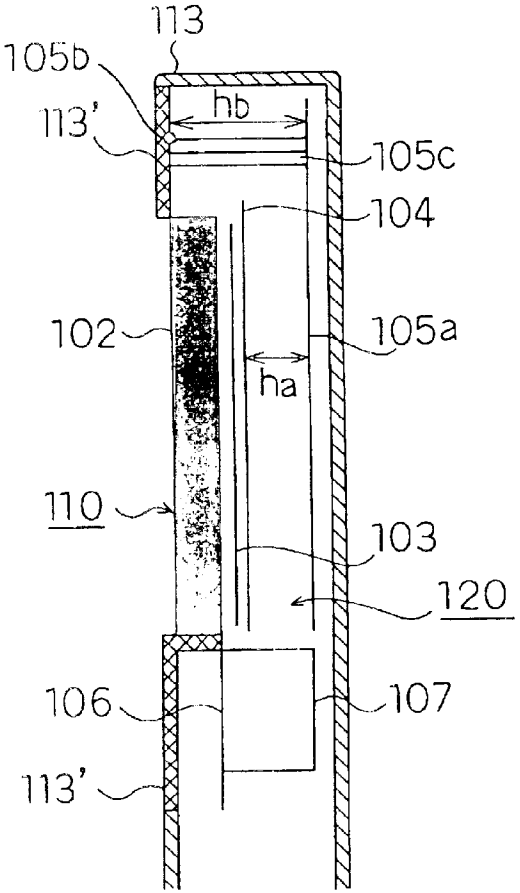
FIG. 7(*a*) is a front view showing a configuration of a communication apparatus according to a related technique of the present invention.
Figure 7:
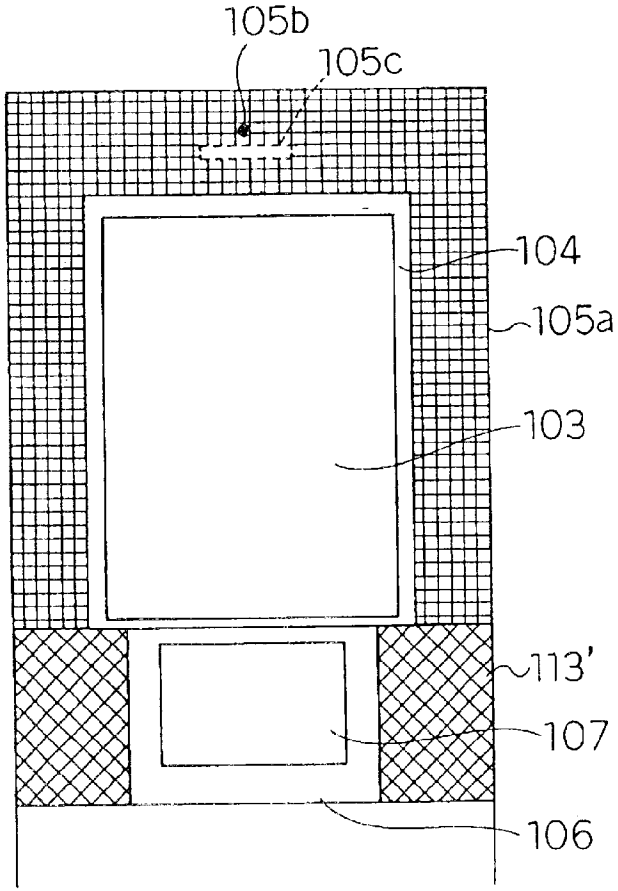

FIG. 7(*a*) is a front view showing a configuration of a communication apparatus according to a related technique of the present invention. FIG. 7(*b*) is a side view showing the same. In FIGS. 7(*a*) and 7(*b*), the same members and the corresponding members of FIG. 1 are indicated by the same reference numerals, and specific explanation thereof is omitted.

The communication apparatus of the present related technique comprises a liquid crystal display 110 built into a housing 113, which is rectangular in sectional view, a built-in antenna 105 provided on the back of the liquid crystal display 110, a substrate 106 provided on the bottom the liquid crystal display 110, and a driver circuit 107 provided on the back of the substrate 106.

Further, the liquid crystal display 110 is constituted by a display main body 102, a nonconductive reflecting plate 103 provided on the back of the image display screen of the display main body 102, and a frame 104 which is a nonconductive member shaped like quasi-U for storing the display main body 102 and the reflecting plate 103. The liquid crystal display 110 is driven by the driver circuit 107 and displays an image on the image display screen of the display main body 102.

Besides, an antenna element 105*a* shaped like quasi-U is extended around the display main body 102, and the extended part is opposed to a metallic part 113' provided around the liquid crystal display 110. Moreover, on the extended part, the antenna element 105*a* is operated by feeding from a feeding point 105*b* provided on the metallic part 113'. Further, an end of the antenna element 105*a* is electrically connected to the metallic part 113' via a metallic connecting part 105*c*.

In the communication apparatus configured thus according to the present related technique, the antenna element 105*a* is directly provided on the back of the liquid crystal display 110, and the metallic part 113' and the antenna element 105*a* are connected to each other via the connecting part 105*c*, so that the metallic part 113' functions as a grounding plate of the antenna element 105*a*. Namely, in the communication apparatus of the present embodiment, the liquid crystal display 110 and the housing 113 are not electrically connected to each other, and the built-in antenna is constituted by the antenna element 105*a* and the metallic part 113' of the housing 113.

In the case where such a communication apparatus is used for a portable communication terminal, when a space for placing the liquid crystal display is available inside the housing of the portable communication terminal, the antenna can be simultaneously provided in the space, so that the space for the built-in antenna merely requires an area of the connecting point and the feeding point.

Therefore, it is not necessary to have a large space for the built-in antenna, thereby achieving a thin portable communication terminal.

Figure 8:
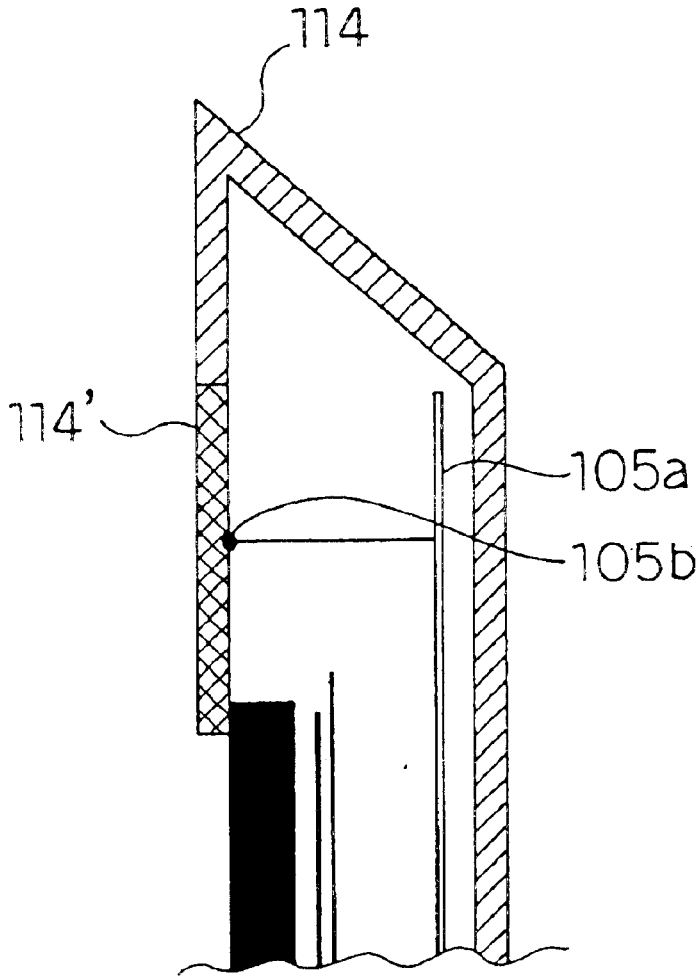
FIG. 8 is a diagram showing another configuration example of a communication apparatus according to Embodiment 4 or a related technique of the present invention.

Additionally, Embodiment 4 and the related technique described that the housing 113 is rectangular in cross section, and the upper parts in parallel with the display main body 102 are all used as the metallic parts 113'. As shown in FIG. 8, a communication apparatus such as a folding-type mobile phone terminal may have a housing 114 having a hypotenuse in cross section. In this case, the housing 114 only needs to have a part opposed to the antenna element 105*a* as a metallic part 114', and in some cases, the uppermost end is not made of a metal to more readily adjust the impedance characteristic. Further, the uppermost end is made of a nonmetal, so that a density of current on the uppermost end can be lower and lower SAR can be expected. Here, as to a lower part in parallel with the display main body 102, a part not being opposed to the antenna element 105*a* may be formed as a metallic part 114'. Hence, it is possible to further improve the grounding of the antenna element.

Embodiment 5

Figure 9:
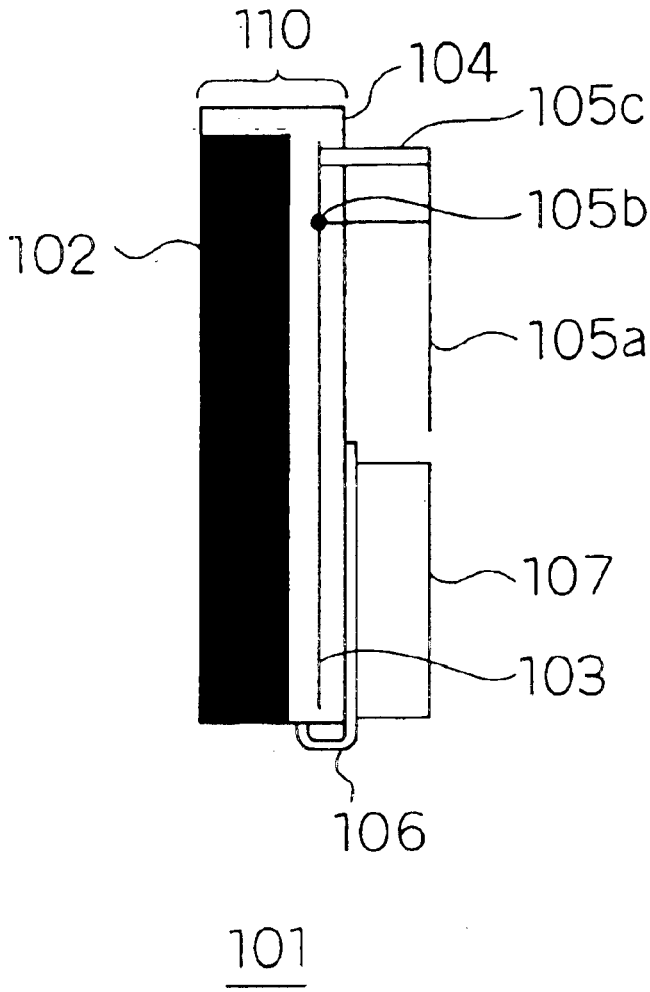
FIG. 9 is a side view showing a configuration of an antenna-liquid crystal integral module according to Embodiment 5 of the present invention.

FIG. 9 is a side view showing a configuration of an antenna-liquid crystal integral module according to Embodiment 5 of the present invention.

In FIG. 9, the same members and the corresponding members of FIG. 1 are indicated by the same reference numerals, and specific explanation thereof is omitted.

The present embodiment is different from Embodiment 1 in that an antenna element 105*a* opposed to a conductive reflecting plate 103 is shorter on the lower part in a surface direction of a liquid crystal display 110, a substrate 106 is bent over the bottom of the frame 104 that is formed by shortening the antenna element 105*a*, and a driver circuit 107 is placed thereon.

Thus, since it is possible to omit a space occupied by a driver circuit below the liquid crystal display 110, when the antenna-liquid crystal integral module of the present embodiment is used for a communication apparatus, the housing can be thinner and smaller in size. Such an antenna-liquid crystal integral module of the present embodiment is suitable particularly for folding-type mobile phone terminals.

Additionally, although the above explanation discussed the antenna-liquid crystal integral module of Embodiment 1 as an example, the present embodiment is also applicable to the configurations of Embodiments 2 to 4, and the same effects as those of the embodiments can be obtained. That is, like Embodiment 2, the frame 104 is used as the metallic frame 104'. Like Embodiment 3, the metallic frame 104' may be extended upward or downward or in a vertical direction along a surface direction of the display main body 102. Moreover, like Embodiment 4, the following configuration is also applicable: the antenna-liquid crystal integral module of the present embodiment is stored in a housing 113 which has the upper part of the display main body 102 partially as a metallic part 113' and is rectangular in cross section, and the metallic part 113' and the metallic frame 104' are electrically connected to each other. Further, as the antenna element and the display in the communication apparatus of the related technique, the antenna-liquid crystal integral module of the present embodiment is also applicable.

Besides, in the present embodiment, it is desirable that the driver circuit 107 be mounted with higher density than those of Embodiments 1 to 4 to maximize a length of the antenna element 105*a* on the lower part in the surface direction of the liquid crystal display 110.

Embodiment 6

Figure 16:
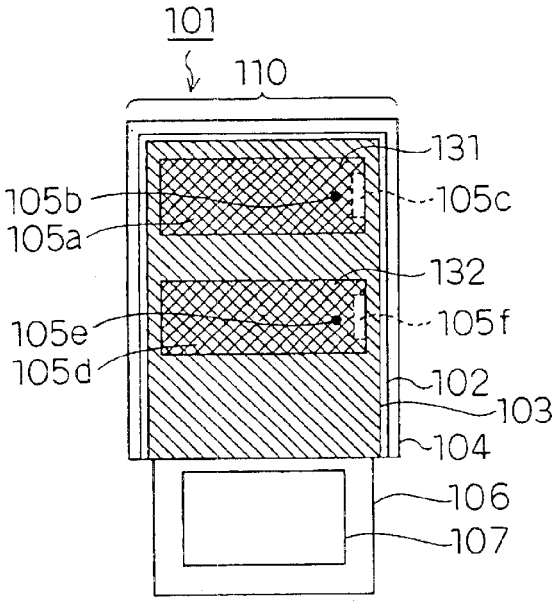
FIG. 16(*a*) is a rear view schematically showing a configuration of an antenna-liquid crystal integral module according to Embodiment 6 of the present invention.
Figure 16:
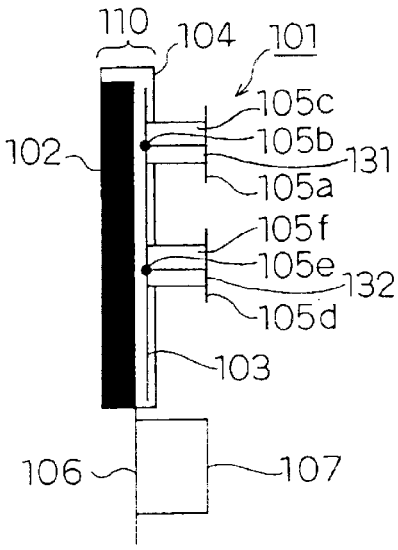

FIG. 16(*a*) is a rear view showing a configuration of an antenna-liquid crystal integral module according to Embodiment 6 of the present invention. FIG. 16(*b*) is a side view showing the same. In both of the drawings, the same members or the corresponding members of FIG. 1 are indicated by the same reference numerals, and the specific explanation thereof is omitted.

In the antenna-liquid crystal integral module of the present embodiment, the antenna element 105*a* is reduced in area, and an antenna element 105*d* having the same shape is further provided below the antenna element 105*a*. Like the antenna element 105*a*, the antenna element 105*d* is operated by feeding from a feeding point 105*e* provided in a plane that is provided on a reflecting plate 103 and opposed to a display main body 102 and the reflecting plate 103, and has an end electrically connected to the reflecting plate 103 via a connecting part 105*f* made of a metal. In this case, output to the feeding point 105*e* is supplied from communication means (not shown) on a substrate 106.

That is, the antenna-liquid crystal integral module of the present embodiment has two antenna elements having two built-in antenna 131 and 132 which share a grounding plate. Thus, the two built-in antenna are each used for transmission and reception by using the same module, so that it is expected that isolation increases between transmission and reception.

In this case, the built-in antenna 131 and the built-in antenna 132 may cover different frequency bands, or one of the built-in antennas may cover a plurality of frequency bands.

Also, one of the built-in antenna 131 and the built-in antenna 132 may be used only for transmission and the other may be used only for reception. Additionally, in this configuration, the built-in antenna for reception may not be fed but may be caused to operate as a passive element during transmission, and the built-in antenna for transmission may not be fed but may be caused to operate as a passive element during reception. Moreover, the built-in antenna used for transmission and the built-in antenna used for reception may cover different frequency bands. Thus, each of the antenna elements covers a narrow band as compared with the case where a single antenna element covers all the frequency bands. Further, a wider band of the antenna element can be expected by using the passive element, and directional gain can be varied to intensively radiate radio waves in a desired direction. As a result, it is expected that each of the antenna elements is reduced in size and thickness. Besides, in the case where a transmission frequency and a reception frequency are away from each other, for example, in PDC and W-CDMA, more effects can be obtained.

Figure 17:
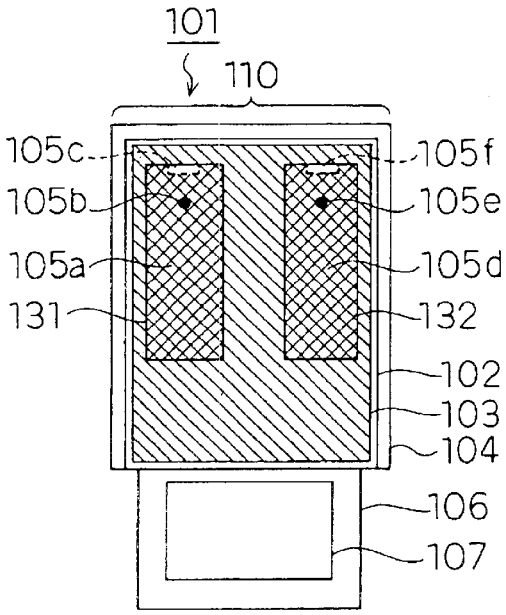
FIG. 17(*a*) is a rear view showing another configuration example of the antenna-liquid crystal integral module according to Embodiment 1 of the present invention.
Figure 17:
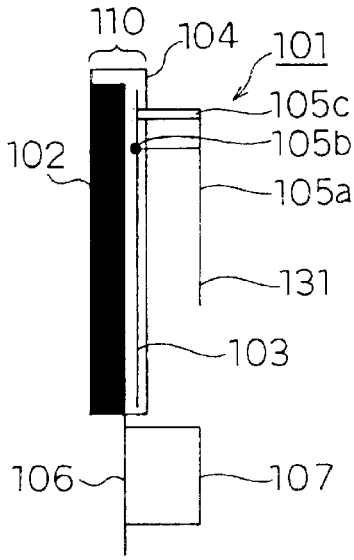

Besides, in the above explanation, the antenna elements 105*a* and 105*d* are arranged vertically along the display main body 102. As shown in FIGS. 17(*a*) and 17(*b*), the antenna elements 105*a* and 105*d* may be arranged laterally. In this case, even when the housing for storing the antenna-liquid crystal integral module has a tapered shape, which is smaller in thickness on a higher part, it is possible to achieve an antenna-liquid crystal integral module which is substantially symmetrical in a lateral direction.

Further, although the above explanation discussed two built-in antennas, three or more antennas may be provided. That is, the configuration may comprise three or more antenna elements.

Moreover, the above explanation discussed the antenna-liquid crystal integral module of Embodiment 1 as an example. The present embodiment is also applicable to Embodiments 2 to 5 and obtains the same effects as those of the embodiments. That is, like Embodiment 2, the frame 104 may be replaced with the metallic frame 104'. Like Embodiment 3, the metallic frame 104' may be extended upward or downward or in a vertical direction along the surface direction of the display main body 102. Moreover, like Embodiment 4, the following configuration is also applicable: the antenna-liquid crystal integral module of the present embodiment is stored in a housing 113 which has a part of the upper part of the display main body 102 as a metallic part 113' and is rectangular in cross section, and the metallic part 113' and the metallic frame 104' are electrically connected to each other. Further, as the antenna element and the display in the communication apparatus the related technique, the antenna-liquid crystal integral module of the present embodiment is also applicable.

Such an antenna-liquid crystal integral module of the present embodiment is suitable particularly for folding-type mobile phone terminals.

Embodiment 7

Figure 10:
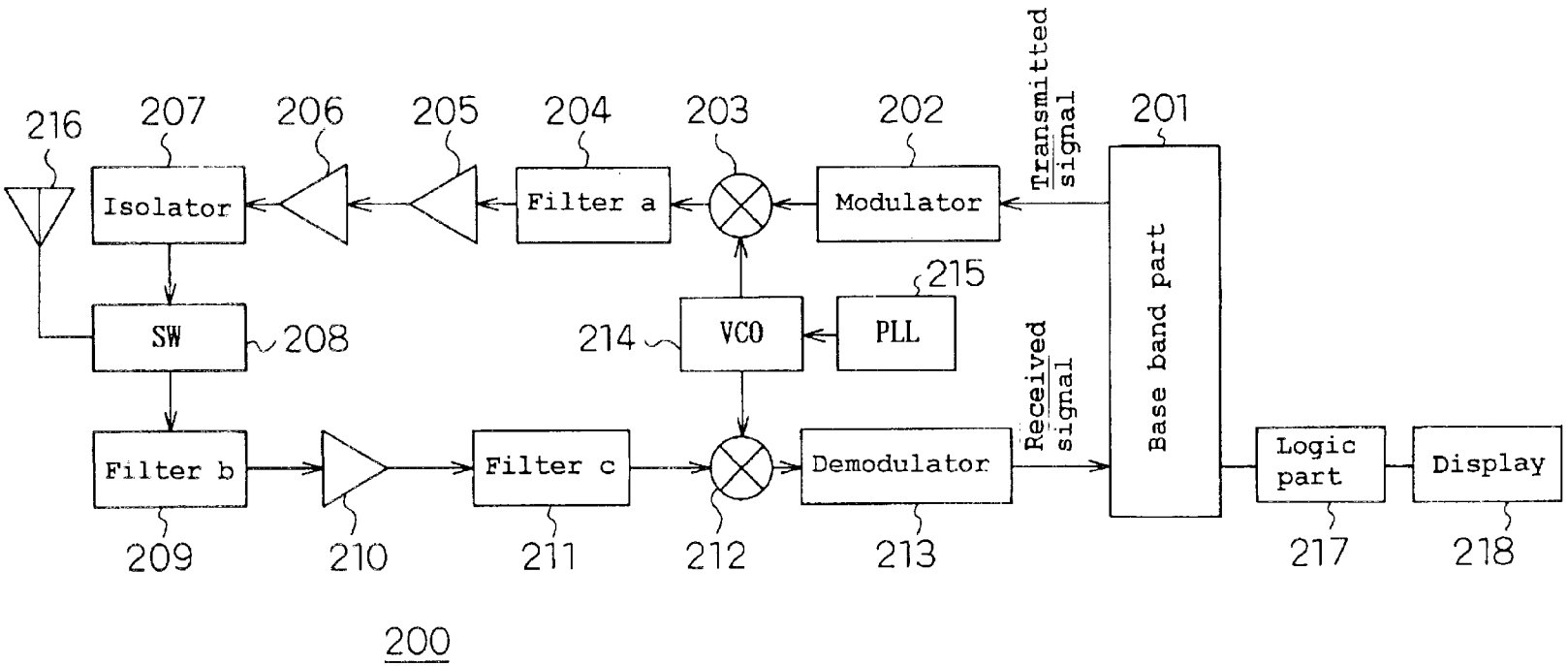
FIG. 10 is a block diagram showing the configuration of a radio device having the antenna-liquid crystal integral modules or communication apparatuses according to the embodiments of the present invention.

FIG. 10 is a block diagram showing a configuration of a radio device having the antenna-liquid crystal integral module or the communication apparatus according to the embodiments of the present invention.

In FIG. 10, a base band part 201 is means of outputting a transmitted signal such as voice data and image data and receiving input of a received signal, a modulator 202 is means of modulating a transmitted signal, a mixer a203 is means of mixing a modulated signal with a signal outputted from a voltage control oscillator (VCO) 214 and outputting the mixed signal, a filter a204 is means of passing a prescribed band from a signal outputted from the mixer a203, and gain control amplifier (GCA) 205 and a power amplifier (PA) 206 are means of amplifying the output of the filter a204.

Further, a filter b209 is means of passing only a signal of a prescribed band from input of an antenna 216, a low-noise amplifier (LNA) is means of amplifying noise components from input, a filter c209 is means of passing components other than noise components from input, a mixer b212 is means of mixing a high-frequency signal outputted from a filter 211*c* with a signal outputted from a voltage control oscillator (VCO) 214 and outputting the mixed signal as an intermediate-frequency signal, and a demodulator 213 is means of demodulating an intermediate-frequency signal from the mixer b212 to obtain a received signal.

Further, a logic part 217 is means of retrieving an aural signal from a microphone, etc. (not shown), performing A/D conversion and so on, and outputting the signal to the base band part 201, and a display 218 is means of displaying a video signal. When a signal received by the receiving means is a video signal, the displays 218 also provides a display of the signal.

In the above configuration, in a processing systems of a transmitted signal which corresponds to modulating means of the present invention, the modulator 202, the mixer a203, the VCO 214, and a PLL 215 correspond to transmitting means of the present invention and the filter a204 corresponds to the transmission-side filter means of the present invention and the GCA 205 and the PA 206 correspond to transmission-side amplifying means of the present invention. Further, in a processing systems of a received signal which correspond to receiving means of the present invention, the filter b209 and the filter c211 correspond to reception-side filter means of the present invention, and an LNA 210 corresponds to a reception-side amplifying means of the present invention. Furthermore, the mixer b212, the demodulator 213, the VCO 214, and a PLL 215 correspond to modulating means of the present invention. Further, in the processing systems of a transmitted signal, an isolator 207 is means of preventing a wave received from the antenna 216 from being inputted to a PA 16, and an antenna switch (SW) 208 is means which is shared by the processing system of a transmitted signal and the processing system of a received signal and switches input/output to the antenna 216. Besides, the SW 208 corresponds to the antenna connection switching means of the present invention.

Moreover, among signals processed in the base band part 201 and the logic part 217, a video signal is displayed on a display 217.

In such a radio device, the antenna 216 and the display 217 are realized by the antenna-liquid crystal integral module or the communication apparatus according to Embodiments 1 to 7 of the present invention, so that it is possible to achieve a thin and small portable communication terminal.

As the radio device, a mobile phone for transmitting and receiving voice data and image data including a static image and a moving image is also applicable, and a portable communication terminal such as a PDA for transmitting and receiving image data and character data is also applicable.

Moreover, the configurations of the transmitting means and the receiving means are not limited to those of FIG. 10 as long as transmission and reception can be performed using the antenna 216.

Figure 11:
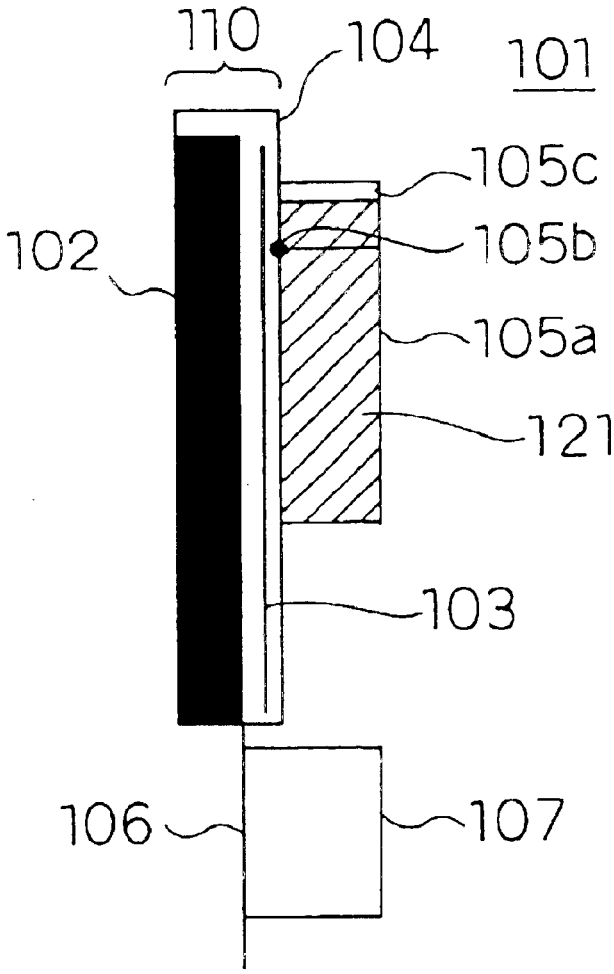
FIG. 11 is a diagram showing another configuration example of the antenna-liquid crystal integral modules according to the embodiments of the present invention.
Figure 13:
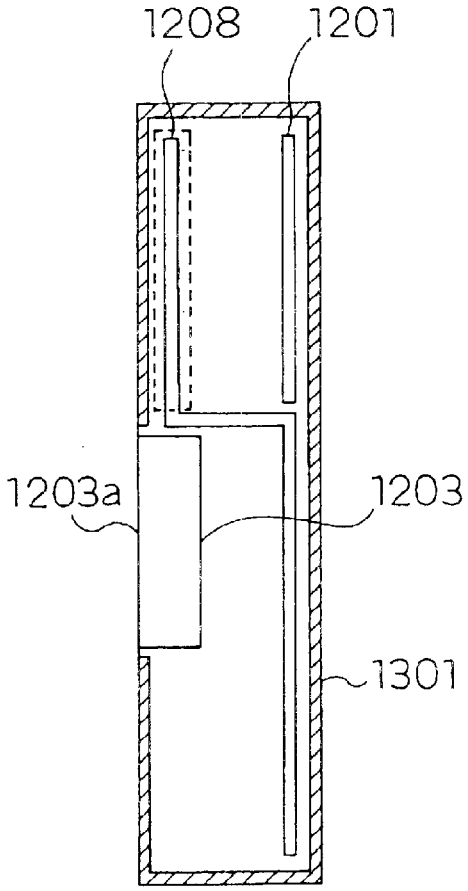
PRIOR ART Fig. 13 (a)
FIG. 13(*a*) is a side sectional view schematically showing a mobile phone terminal according to a conventional technique.
Figure 13:
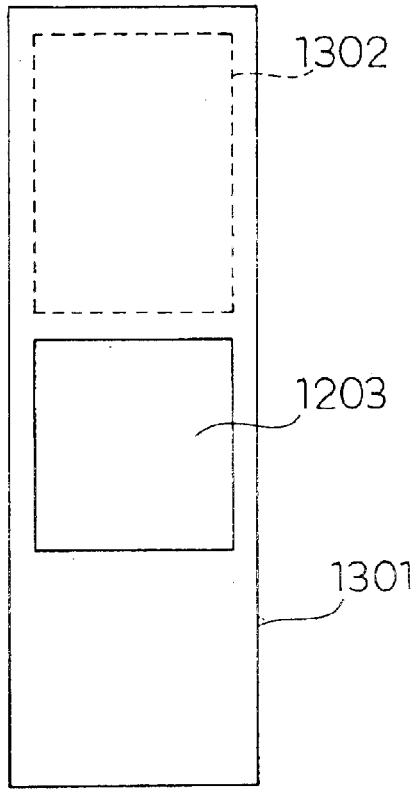
PRIOR ART Fig. 13 (b)

Additionally, the above-described embodiments discussed that a space is provided between the antenna element and the reflecting plate 103, the metallic frame 104', or the metallic part 113. As shown in FIG. 11, by taking Embodiment 1 as an example, a dielectric material 121 may be filled in a space formed by opposing the liquid crystal display 110 and the antenna element 105*a*. In this case, the dielectric material may be filled entirely in the space formed by opposing the liquid crystal display 110 and the antenna element 105*a* or may be partially filled therein.

Moreover, in the case of the configuration example shown in FIG. 6 of Embodiment 4, a dielectric material maybe filled between the metallic part 113' and the antenna element.

According to such a configuration, the dielectric material 121 is interposed between the antenna element 105*a* and the reflecting plate 103, so that a resonance frequency of the antenna element 105*a* can be reduced. Hence, the antenna is expected to be smaller in size, and since the filled dielectric material functions as a reinforcing material, it is expected that the strength of the antenna-liquid crystal integral module can be increased. Such an antenna-liquid crystal integral module of the present embodiment is suitable particularly for folding-type mobile phone terminals.

Additionally, the antenna element 105*a* may be configured so as to produce resonance in a single frequency band or in a plurality of frequency bands.

Besides, in the above-described embodiments, the antenna-liquid crystal integral module 101 corresponds to the display-antenna integral structure of the present invention, the antenna element 105*a* corresponds to the antenna element of the present invention, the reflecting plate 103, the metallic frame 104', and the metallic parts 113' and 114' correspond to the grounding plates of the present invention, and the driver circuit 107 corresponds to the driving circuit of the present invention. Additionally, the display main body 102 corresponds to the display main body of the present invention, the metallic reflecting plate 103 and the nonconductive reflecting plate 103' correspond to the reflecting plates of the present invention, and the liquid crystal display 110 corresponds to the display of the present invention. The frame 104 and the metallic frame 104' correspond to the frames of the present invention, and instead of the metallic frame 104', a material such as conductive plastic, which is nonmetallic and is conductive, may be used for the frame of the present invention. Moreover, any material is applicable for the metallic reflecting plate 103 as long as it is conductive, so that a conductive plastic which is nonmetallic and conductive is applicable. Instead of metallic parts 113' and 114', a material such as a conductive plastic, which is nonmetallic and conductive, is also applicable to a housing used in common as the grounding plates of the present invention.

Further, the display of the present invention may comprise a reflecting plate, a liquid crystal display, or other kinds of display. Furthermore, the display of the present invention may be realized by a liquid crystal display not using a reflecting plate or by a display such as a plasma display.

Moreover, the above-described embodiment discussed that the display has the display main body, the frame, and the reflecting plate. The display of the present invention may have other configurations such as a configuration not having a frame as long as the display partially has conductivity and is commonly used as the grounding plate of the antenna.

As is apparent from the above explanation, the present invention makes it possible to obtain a display-antenna integral structure, a communication apparatus, and a portable communication terminal that can sufficiently have a space for a built-in antenna and reduce a thickness of the housing.

What is claimed is:

1. A display-antenna integral structure comprising an antenna and a display wherein said antenna has an antenna element and a grounding plate, said antenna element and said display are opposed to each other, a part of said display has conductivity and is used as said grounding plate, a feed point disposed on said grounding plate having a transverse connection to a plane of the antenna element, and the display completely overlaps the antenna element.

2. The display-antenna integral structure according to claim 1, wherein said display comprises a display main body, a frame provided around said display main body, and a reflecting plate provided on a back of an image display screen of said display, and all or part of said reflecting plate has conductivity and is used as said grounding plate.

3. The display-antenna integral structure according to claim 2, wherein said reflecting plate and said antenna element are integrally-molded.

4. The display-antenna integral structure according to claim 1, wherein said display comprises a display main body, and a frame provided around said display main body, and all or part of said frame has conductivity and is used as said grounding plate.

5. The display-antenna integral structure according to claim 4, wherein said frame and said antenna element are integrally-molded.

6. The display-antenna integral structure according to claim 4 or 5, wherein said display further comprises a reflecting plate provided on a back of an image display screen of said display, and all or part of said reflecting plate has conductivity and is used as said grounding plate.

7. The display-antenna integral structure according to claim 6, wherein said frame and reflecting plate are integrally-molded and are used as said grounding plate.

8. A communication apparatus comprising said display-antenna integral structure according to claim 1, and a housing for storing said display-antenna integral structure, wherein at least all or part of said housing opposed to said antenna element has conductivity and is used as said grounding plate.

9. The display-antenna integral structure according to claim 1, wherein no driving circuit for driving said display is provided between said antenna element and said display.

10. The display-antenna integral structure according to claim 1, further comprising a dielectric provided entirely or partially in a space between said antenna element and said grounding plate.

11. The display-antenna integral structure according to claim 1, wherein said antenna resonates at a plurality of frequencies.

12. The display-antenna integral structure according to claim 4, wherein a part of said frame on the side of said image display screen extends on a surface space adjacent to said display, said antenna element partially extends in a direction of said surface space, said extended frame and said antenna element are opposed to each other in said surface space, and a feeding point of said antenna element is provided on said opposing part.

13. The communication apparatus according to claim 8, wherein said antenna element partially extends in a direction of a surface space adjacent to said display, said extended antenna element is partially opposed to the conductive part of said housing, and a feeding point of said antenna element is provided on said opposing part.

14. The display-antenna integral structure according to claim 1, wherein said antenna element and said display are partially opposed to each other, and a driving circuit for driving said display is provided on a back of a remainder of said display, said remainder not being opposed to said antenna element.

15. The communication apparatus according to claim 8, wherein a part not being opposed to said antenna element on said housing has no conductivity.

16. The display-antenna integral structure according to claim 1, wherein said antenna further comprises a passive element on a side having said antenna element placed thereon, said element being opposed to said display.

17. The display-antenna integral structure according to claim 1, further comprising a plurality of said antenna elements.

18. The display-antenna integral structure according to claim 17, wherein any one of said plurality of antenna elements is used for transmission and the others are used for reception.

19. The display-antenna integral structure according to claim 17, wherein said plurality of antenna elements resonate at different frequency bands.

20. The display-antenna integral structure according to claim 17, wherein at least two of said plurality of antenna elements are resonated simultaneously.

21. A portable communication terminal comprising: said communication apparatus according to claim 8;

transmitting means of transmitting a radio wave signal from said antenna; and receiving means of receiving a radio wave signal inputted from said antenna.

22. The portable communication terminal according to claim 21, comprising said antenna and antenna connection switching means of switching connection with said transmitting means or said receiving means, wherein said transmitting means comprises:

modulating means of modulating an aural or video signal;

transmission-side filter means of allowing passage through a specific band of said modulated signal; and transmission-side amplifying means of amplifying a signal passing through said transmission-side filter means, and said receiving means comprises:

receiving-side amplifying means of a signal inputted from said antenna;

reception-side filter means of allowing passage through a specific band of a signal inputted from said antenna and/or said amplified signal; and demodulating means of demodulating a signal passing through said reception-side filter means to obtain an aural or video signal.

23. The mobile phone terminal according to claim 21 or 22, wherein said transmitting means performs at least transmission of voice data, and said receiving means performs at least reception of voice data, and said terminal is used as a mobile phone.

* * * * *